US009457488B2

(12) United States Patent
Yamada et al.

(10) Patent No.: US 9,457,488 B2
(45) Date of Patent: Oct. 4, 2016

(54) BLADE MOUNT OF ROTARY DIE CUTTER, AND METHOD AND DEVICE FOR FIXING BLADE MOUNT

(75) Inventors: Hironari Yamada, Mihara (JP); Osamu Hatano, Mihara (JP)

(73) Assignee: MITSUBISHI HEAVY INDUSTRIES PRINTING & PACKAGING MACHINERY, LTD., Hiroshima (JP)

( * ) Notice: Subject to any disclaimer, the term of this patent is extended or adjusted under 35 U.S.C. 154(b) by 776 days.

(21) Appl. No.: 13/508,117

(22) PCT Filed: Oct. 28, 2010

(86) PCT No.: PCT/JP2010/069178

§ 371 (c)(1),
(2), (4) Date: May 4, 2012

(87) PCT Pub. No.: WO2011/062038

PCT Pub. Date: May 26, 2011

(65) Prior Publication Data

US 2012/0216662 A1 Aug. 30, 2012

(30) Foreign Application Priority Data

Nov. 20, 2009 (JP) ..... 2009-264702

(51) Int. Cl.
*B26D 1/24* (2006.01)
*B26F 1/44* (2006.01)
(Continued)

(52) U.S. Cl.
CPC ..... *B26F 1/44* (2013.01); *B26F 1/384* (2013.01); *B31F 1/10* (2013.01);
(Continued)

(58) Field of Classification Search
CPC ..... B26F 1/44; B26F 1/384; B26F 1/10; Y10T 29/49959; Y10T 83/9464; Y10T 83/4795; B26D 2007/2607; B26D 2007/2657; B31B 2201/143; B31B 2201/146; B31B 2201/257
USPC ..... 83/698.41, 338, 332, 504, 663, 498, 83/598, 469, 343, 345, 331
See application file for complete search history.

(56) References Cited

U.S. PATENT DOCUMENTS 3,641,857 A * 2/1972 Vande Castle ..... 83/322
3,646,418 A * 2/1972 Sterns et al. ..... 318/603
(Continued)

FOREIGN PATENT DOCUMENTS

DE 3738196 A1 5/1989
JP EP 0728560 A1 * 8/1996 ..... B26D 7/2614
(Continued)

OTHER PUBLICATIONS

International Search Report for PCT/JP2010/069178, dated Nov. 30, 2010.
(Continued)

*Primary Examiner* — Omar Flores Sanchez
(74) *Attorney, Agent, or Firm* — Kanesaka Berner & Partners, LLP

(57) ABSTRACT

A blade mount is attached or detached without bolts to save the time for the attaching and the detaching. Consequently, the operation efficiency of the rotary die cutter is enhanced, which is intended to achieve. Two fixing rings are freely fitted to a knife cylinder and the driving unit rotates the screw axis to move moving mounts. Thereby, yoke plates disposed on the moving mounts move the fixing rings to the end portion of a blade mount, and then an activated unit activates fixing units to fix the fixing rings to the outer circumference face of the knife cylinder, so that the blade mount is fixed. After the fixing rings are fixed, the yoke plates are separated from the fixing rings, so that abrasion of the yoke plates can be avoided.

8 Claims, 12 Drawing Sheets

(51) Int. Cl.

| | |
|---|---|
| ***B26F 1/38*** | (2006.01) |
| ***B31F 1/10*** | (2006.01) |
| *B26D 7/26* | (2006.01) |

(52) U.S. Cl.

CPC ..... *B26D 2007/2607* (2013.01); *B26D 2007/2657* (2013.01); *B31B 2201/143* (2013.01); *B31B 2201/146* (2013.01); *B31B 2201/257* (2013.01); *Y10T 29/49959* (2015.01); *Y10T 83/4795* (2015.04); *Y10T 83/9464* (2015.04)

(56) References Cited

U.S. PATENT DOCUMENTS

| | | | | | |
|---|---|---|---|---|---|
| 3,863,537 | A | * | 2/1975 | Huelsman | 83/503 |
| 4,162,643 | A | * | 7/1979 | Coburn | 83/499 |
| 4,220,064 | A | * | 9/1980 | Potter | 83/665 |
| 4,781,668 | A | * | 11/1988 | Mowry | 493/365 |
| 4,843,933 | A | * | 7/1989 | Seki et al. | 83/508.3 |
| 4,926,730 | A | * | 5/1990 | Garrett | 83/499 |
| 4,993,293 | A | * | 2/1991 | Christoffersson et al. | 83/98 |
| 5,297,464 | A | * | 3/1994 | Mayer | 83/499 |
| 5,316,538 | A | * | 5/1994 | Hill et al. | 493/355 |
| 5,338,019 | A | * | 8/1994 | Hill et al. | 271/139 |
| 5,351,589 | A | * | 10/1994 | Creaden | 83/678 |
| 5,540,128 | A | * | 7/1996 | Creaden | 83/305 |
| 7,387,057 | B2 | * | 6/2008 | Dedeken et al. | 83/498 |

FOREIGN PATENT DOCUMENTS

| | | | |
|---|---|---|---|
| JP | 8229885 | A | 9/1996 |
| JP | 11010583 | A | 1/1999 |
| JP | 2972756 | B1 | 11/1999 |
| JP | 2000-135699 | A | 5/2000 |
| JP | 2008213123 | A | 9/2008 |

OTHER PUBLICATIONS

International Preliminary Report on Patentability corresponding to PCT/JP2010/069178, dated Jun. 12, 2012.

Decision to Grant a Patent in corresponding Japanese Patent Application No. 2009-264702 mailed Jul. 1, 2014.

* cited by examiner

BLADE MOUNT OF ROTARY DIE CUTTER, AND METHOD AND DEVICE FOR FIXING BLADE MOUNT

RELATED APPLICATIONS

The present application is a National Phase of International Application Number PCT/JP2010/069178, filed Oct. 28, 2010, and claims priority from Japanese Application Number 2009-264702, filed Nov. 20, 2009.

TECHNICAL FIELD

The present invention relates to a method for fixing a blade mount and an apparatus for fixing a blade mount which make it easy to attach, without requiring bolts, in the blade mount to a rotary die cutter used for processing corrugated board.

BACKGROUND

In fabricating corrugated board boxes, a rotary die cutter as depicted in FIG. 14 is typically used. Such a rotary die cutter marks off and punches corrugated board sheets underwent printing processing. Hereinafter, description will now be made in relation to the overview of a rotary die cutter disclosed in Patent Literature 1 with reference to FIG. 14.

A rotary die cutter 200 depicted in FIG. 14 includes a pair of parallel frame 214*a* (on the operating side) and 214*b* (on the driving side) which are respectively disposed on the left end and the right end and which are coupled via an upper stay 212 and a lower stay 212 extending the cross direction of the rotary die cutter 200. An anvil cylinder 202 and a knife cylinder 203 that are extending in the cross direction and that have the same diameter are pivotally supported respectively at the upper portion and the lower portion of the frames 214*a* and 214*b*. Into the driving-side ends of the cylinders 202 and 203, gears 215 and 216 are respectively fitted and are rotated in synchronization with each other by a non-illustrated gear driving unit, so that the anvil cylinder 202 and the knife cylinder 203 rotate in the different directions in synchronization with each other.

A pair of forwarding rolls 217*a* and 217*b* in the same shape are disposed at the upstream of the cylinders 202 and 203, respectively, so that corrugated board sheets 201 are fed into the space between the cylinders 202 and 203. On the outer circumference face of the knife cylinder 203, a blade mount 204, which is normally made by wood and which includes a cutting knife 205 or a creaser knife attached to the mount, is attached.

Corrugated board sheets 201 sequentially forwarded from the previous printing process by the forwarding rolls 217*a* and 217*b* are sandwiched between the anvil cylinder 202 and the knife cylinder 203, where the sheets 201 undergo punching or marking off by the cutting knife 205 or the creaser knife.

Patent Literature 1 further discloses fixing means that fixes the blade mount to the knife cylinder. Hereinafter, the configuration of the fixing means is to be detailed with reference to FIG. 15.

In FIG. 15, a number of screw holes 206 are arranged along the circumference direction and the cylinder axis direction at predetermined intervals. Here, the positional relationship of the screw holes 206 to a metal patch 207, which is fixed to the knife cylinder in the axis direction of the knife cylinder 203, is determined to be a constant value.

A pair of fixing rings 208*a* and 208*b* are freely fitted to the both end portions of the knife cylinder 203 so as to be slidable in the axis direction of the knife cylinder 203 (indicated by the arrows). The fixing rings 208*a* and 208*b* are fixed to the knife cylinder 203 by bolts 211.

As depicted in FIG. 15(C), the entire circumferences of the fixing rings 208*a* and 208*b* take forms of rising slope toward the center of the cylinder. The front end and the both side ends of the blade mount fixing the cutting knife 205 take forms of descending slope. In addition, reinforcement metals 210 conforming to the above upward and descending slopes are provided.

The descending slopes of the blade mount 204 forms the same slope angle as the upward slops formed on the rear end of the rectangular-shaped metal patch 207 and the upward slops of the fixing rings 208*a* and 208*b* such that the entire faces of the descending slopes are in contact with the entire surface of the corresponding rising slopes.

In order to fix the blade mount 204, the front end of the blade mount 204 is firstly inserted into the slope surface of the metal patch 207 so as to determine the position of the circumference direction, and then the blade mount 204 is fixed to the outer circumference face of the knife cylinder 203 by flush bolt 209.

Next, the fixing rings 208*a* and 208*b* on the both side ends are moved toward the center and are inserted and fixed to the both side ends of the blade mount 204. Then, pressing the blade mount 204 via the slope face, the fixing rings 208*a* and 208*b* are fixed to the knife cylinder 203 by a number of bolts 211.

PRIOR ART REFERENCE

Patent Literature

[Patent Literature 1]: Japanese Laid-Open Patent Publication No. HEI 8-229885

SUMMARY OF INVENTION

Problems to be Solved by Invention

Many bolts have conventionally been used for fixing a blade mount to a knife cylinder. Tap holes for such bolts are formed at a pitch of, for example, 50 mm over the entire outer circumference face of the knife cylinder. The positions of the tap holes are adjusted to match attaching holes formed on the blade mount and bolts fitted into the holes tighten the blade mount to the knife cylinder.

Under the above state of determining the position of the blade mount on the outer circumference face of the knife cylinder, the installing bolts are screwed into the holes one by one. Similarly, when the blade mount is to be detached, the installing bolt is removed one by one. That has taken a long time to attach and detach the blade mount.

The number of bolts required bolts varies with the shape of a blade mount. A blade mount especially large in size requires an additional longer time to be attached and detached, and a single operator has a difficulty in accomplishing the attachment and detachment.

For the above, the fixing means disclosed in Patent Literature 1 uses the two fixing rings 208*a* and 208*b* to fix the both side ends of the blade mount 204, which consequently largely reduces the number of required installing bolts. However, even the number of installing bolts is reduced, it is still required a number of bolts and a long time to attach the metal patch 207 and the fixing rings 208*a* and

208*b* to the outer circumference face of the knife cylinder. This means that the attaching and detaching still requires considerable time In recent fabrication of corrugated boards, small-lot production has been demanded, which requires frequent replacement of a blade mount. For the above, the productive efficiency largely depends on time length for replacing a blade mount.

With the foregoing problems in view, the object of the present invention is to enhance the operation efficiency of the rotary die cutter by reducing time required for attaching and detaching the blade mount in the manner without requiring the installing bolts.

Means to Solve the Problems

In order to attain the above object, the present invention provides a method for fixing a blade mount of a rotary die cutter, the blade mount being positioned on the outer circumference of a knife cylinder, the method including: moving the two fixing rings, having recess grooves on the respective outer circumferences and being freely fitted to the both end portions of the knife cylinder, toward the center of the knife cylinder by moving yokes placed inside the respective recess grooves of the fixing rings; holding and fixing the blade mount at the both end portions along the axis direction of the knife cylinder by the fixing rings; fixing the fixing rings to the outer circumference of the knife cylinder by fixing devices provided one for each of the fixing rings.

The method of the present invention fixes the two fixing rings that hold and fix the both end portions of the blade mount, the end portions being along the axis direction of the knife cylinder, to the outer circumference of the knife cylinder by the fixing devices, which can eliminate the requirement of bolts to fix the fixing rings. This largely shortens the time for attaching and detaching the blade mount and consequently, the operation efficiency of the rotary die cutter can be enhanced.

Since the fixing devices fix the fixing rings to the outer circumference of the knife cylinder, the yokes can be separated from the fixing rings during the operation of the rotary die cutter. This configuration can separate the yokes from the rotating fixing rings, and therefore can prevent the yokes from abrasion.

In the method of the present invention, the blade mount may have the both end portions along the axis direction of the knife cylinder, the end portions facing the respective fixing rings and having the circumferences entire of which are chamfered into descending slopes; each of the fixing rings may have an end face facing the blade mount and having an inner circumference entire of which is chamfered into a rising slope; and the rising slopes of the fixing ring depressing the respective descending slopes may fix the both end portions of the blade mount, the end portions being along the axis direction of the knife cylinder, to the outer circumference face of the knife cylinder.

This configuration exerts depressing force that the rising slopes of the fixing rings to the descending slopes of the blade mount, which force to firmly fix the both end portions of the blade mount, the portions being along the axis direction of the knife cylinder, to the outer circumference face of the knife cylinder.

In the method of the present invention, a fitting section, having a recess and a projection along the circumference direction of the knife cylinder, may be formed on part of each end face of the blade mount, the face being along the circumference direction of the knife cylinder; fixing parts, each partially having a stopper that is to be fitted to the fitting section, may be embedded into recesses formed on the outer circumference face of the knife cylinder; and the method may further include determining the position of the blade mount on the outer circumference of the knife cylinder, and moving the blade mount and the fixing parts along the axis direction of the knife cylinder with respect to the blade mount such that the fitting sections and the stoppers are fitted to each other, so that the blade mount is fixed to the outer circumference of the knife cylinder.

This simple configuration makes it possible to rapidly fix the both end portions of the blade mount, the portions being along the circumference direction of the knife cylinder, without using bolts. In conjunction with fixing by the fixing rings, the entire end portions of the blade mount can be rapidly fixed without bolts, so that the operation efficiency of the rotary die cutter can be greatly enhanced.

In the method of the present invention, a fitting section, having a recess and a projection along the circumference direction of the knife cylinder, may be formed on at least part of each end face of the blade mount, the faces being along the circumference direction of the knife cylinder; at least one fixing part having a stopper that is to be fitted to each fitting section may be mounted on the outer circumference face of the knife cylinder so as to be rotatable around an eccentric axis; and the method may further comprise determining the position of the blade mount on the outer circumference of the knife cylinder, and rotating the fixing part around the eccentric axis such that the fitting sections and the stoppers are fitted to each other, so that the blade mount is fixed to the outer circumference of the knife cylinder.

Thereby, likewise the above manner, this simple configuration makes it possible to rapidly fix the both end portions of the blade mount, the portions being along the circumference direction of the knife cylinder, without using bolts. In conjunction with fixing by the fixing rings, the entire end portions of the blade mount can be rapidly fixed without bolts, so that the operation efficiency of the rotary die cutter can be greatly enhanced.

There is provided a device for fixing a blade mount of a rotary die cutter that can be directly applied to the method of the present invention, a cylindrical knife cylinder freely fitting two fixing rings to the knife cylinder, and holding and fixing, using the two fixing rings, the blade mount from the both end portions along the axis direction of the knife cylinder, the device including: two fixing rings, each having a recess groove on the outer circumference and being freely fitted to an end portion of the knife cylinder; fixing ring moving units each including a yoke that is placed in the recess groove of the corresponding fixing ring, and a driving unit that moves the yoke along the axis direction of the knife cylinder; and fixing devices, provided one for each fixing rings, that fix the respective corresponding fixing rings to the outer circumference face of the knife cylinder, wherein the ring moving units moves the respective fixing rings to positions at which the both end portions of the blade mount are to be fixed, the end portions being along the axis direction of the knife cylinder, and the fixing devices fix the respective corresponding fixing rings to the outer circumference face of the knife cylinder at the positions.

The device causes the yokes to move the fixing rings along the axis direction of the knife cylinder and also causes the fixing devices to fix the fixing rings at the positions to fix the blade mount, which can eliminate the requirement of bolts to fix the fixing rings. This largely shortens the time for attaching and detaching the blade mount and consequently, the operation efficiency of the rotary die cutter can be enhanced.

Since the fixing devices fix the fixing rings to the outer circumference of the knife cylinder, the yokes can be separated from the fixing rings during the operation of the rotary die cutter. This configuration can separate the yokes from the rotating fixing rings, and therefore can prevent the yokes from abrasion.

The moving units allow automatic movement of the yokes along the axis direction of the knife cylinder, which makes the operator possible to focus on holding the blade mount onto the outer circumference face of the knife cylinder. Therefore, a single operator can attach and detach the blade mount.

In the device of the present invention, each of the fixing devices may include a depressing member being provided on the corresponding one of the fixing ring and having a depressing face that is to be in contact with the outer circumference face of the knife cylinder, and an activating unit that is attached to the corresponding yoke and that moves the depressing member to a position at which the depressing member is depressed against the outer circumference face of the knife cylinder and moves the depressing member to a position at which the depressing of the depressing member is released; and the activating unit may cancel the depressing to the depressing member while the corresponding fixing ring is moving, and depresses the depressing member against the outer circumference face of the knife cylinder at the position at which the corresponding fixing ring is to be fixed.

With this configuration, the activating units drive the depressing members and thereby the fixing rings can be freely fixed or released to or from the outer circumference of the knife cylinder, so that the blade mount can be efficiently attached.

In addition to the above configuration, each of the activating units may include a spring member that is attached to the corresponding fixing ring and that urges the depressing face of the depressing member to generate elasticity in a direction that the depressing face of the depressing member is depressed against the outer circumference face of the knife cylinder, and a depressing releaser that is attached to the yoke and that releases the depressing of the depressing member against the outer circumference face of the knife cylinder by resisting the elasticity of the spring member, and the depressing releaser may be activated while the corresponding fixing ring is moved and is configured not to be activated at the position at which the corresponding fixing ring is to be fixed.

This simple configuration using the spring members easily switch the fixing state or the releasing state of the fixing rings fixed to the outer circumference face of the knife cylinder by means of elasticity of the spring members.

Furthermore, the depressing member may include a lever attached to the corresponding fixing ring and that is rotatable around the axis of the fixing ring, and a depressing board being attached to a first end of the lever and having the depressing face that is to be in contact with the outer circumference face of the knife cylinder; the spring member may be a disc spring that is attached to a second end of the lever and that urges the depressing face of the depressing board against the outer circumference face of the knife cylinder; the depressing releaser may be an air cylinder that is attached to the yoke and that depresses the second end of the lever so that the depressing of the depressing board against the outer circumference face of the knife cylinder is released.

Using the disc springs as the spring members allows the spring member to have a thickness of the spring members smaller than the thickness of the fixing rings, so that the spring members can be easily mounted to the fixing rings. Furthermore, using air cylinders as the elasticity releasers that release the elasticity of the disc springs and attaching the air cylinders to the yokes make the fixing rings to move to desired positions along the axis direction of the knife cylinder and to be fixed at the positions.

In the device of the present invention, a notch face may be formed on part of an end face of each of the fixing rings, the end face being in the circumference direction, the notch face forming an acute angle with respect to the outer circumference face of the knife cylinder; the depressing member may have an edge in the form of a wedge that is to be placed into a wedge space formed between the outer circumference face of the knife cylinder and the notch face; the spring member may urge the depressing member in the direction of inserting the depressing member into the wedge space to add elasticity; and the depressing releaser may include a stopper that moves the depressing member backward from the wedge space, resisting the elasticity of the spring member, and an air cylinder that moves the stopper to a position at which the stopper stops on the depressing member and moves the stopper to a position at which the stopper is separated from the pressing member.

With this configuration, when the fixing rings are to be fixed to the outer circumference of the knife cylinder, the tip portions of the depressing members inserted into the wedge spaces by the elasticity of the spring members increase the friction force between the fixing rings and the outer circumference of the knife cylinder, so that the retention force of the fixing rings can be increased.

Until the fixing rings are moved to the position to fix the blade mount, the stoppers hold the depressing members at evacuated positions. After the fixing rings are moved to the position to fix, the stoppers are detached from the depressing member so that the depressing members are released from the respective evacuated positions and are inserted into the wedge spaces. Thereby, the fixing ring is fixed to the outer circumference face of the knife cylinder. Consequently, the fixing rings can be automatically moved and fixed to the outer circumference face of the knife cylinder.

In the device of the present invention, each of the fixing ring moving units may include: a screw axis arranged parallel to the axis direction of the knife cylinder and in the vicinity of the knife cylinder; a moving mount that is integrated with the yoke and that is screwed with the screw axis to thereby move on the screw axis; and a driving unit that rotates the screw axis. The yokes can be moved by a simple configuration of a combination of the screw axes and moving mounts that move the screw axes.

There is provide a blade mount of a rotary die cutter used for the method and the device of the present invention that is positioned on the outer circumference face of a cylindrical knife cylinder around which two fixing rings are freely fitted and that is to be held and fixed at the both end portions along the axis direction of the knife cylinder by the fixing rings, the blade mount comprising:

descending slopes formed the entire outer edges on the both end portions along the axis direction of the knife cylinder facing to the fixing rings; a fitting section that has a recess and a projection along the circumference face of the knife cylinder and that is formed on at least part of each end faces along the circumference direction of the knife cylinder; and the both end portions along the axis direction of the knife cylinder being held by the fixing rings and the fitting sections being fitted to stoppers of a fixing members attached to the outer circumference face of the knife cylinder, so that the blade mount is fixed to the outer circumference face of the knife cylinder.

Since the both end portions in the axis direction of the knife cylinder of the blade mount of the present invention are fixed by two fixing rings and the fitting sections formed on the both end faces along the circumference direction of the knife cylinder are fitted to the stoppers of the fixing members, the blade mount can be fixed to the outer circumference of the knife cylinder without using bolts. This configuration makes it possible to attach and detach the blade mount in a short time, so that the efficiency of the operation of the rotary die cutter can be largely enhanced.

Effects of Invention

The present invention provides a method for fixing a blade mount of a rotary die cutter, a cylindrical knife cylinder freely fitting two fixing rings to the knife cylinder, and holding and fixing, using the two fixing rings, the blade mount at the both end portions along the axis direction of the knife cylinder of the blade mount, the method comprising: moving the two fixing rings, having recess grooves on the respective outer circumferences and being freely fitted to the both end portions of the knife cylinder, toward the center of the knife cylinder by moving yokes placed inside the respective recess grooves of the fixing rings; holding and fixing the blade mount at the both end portions along the axis direction of the knife cylinder by the fixing rings; fixing the fixing rings to the outer circumference of the knife cylinder by fixing devices provided one for each of the fixing rings. This configuration eliminates the requirement of bolts to attach and detach the blade mount to the outer circumference face of the knife cylinder, so that the time for attaching and detaching the blade mount can be largely reduced. Concurrently, since yokes are separated from the fixing ring while the rotary die cutter is operating, abrasion of the yokes can be avoided.

The yokes are allowed to automatically move along the axis direction of the knife cylinder, which makes the operator possible to focus on holding the blade mount onto the outer circumference face of the knife cylinder. Therefore, a single operator can attach and detach the blade mount.

Furthermore, the present invention provides a device for fixing a blade mount of a rotary die cutter, a cylindrical knife cylinder freely fitting two fixing rings to the knife cylinder, and fixing, using the two fixing rings, the blade mount from the both end portions along the axis direction of the knife cylinder, the device comprising: two fixing rings, each having a recess groove on the outer circumference and being freely fitted to the both end portions of the knife cylinder; fixing ring moving units each including a yoke that is placed in the recess groove of the corresponding fixing ring, and a driving unit that moves the yoke along the axis direction of the knife cylinder; and fixing devices, provided one for each fixing rings, that fix the respective corresponding fixing rings to the outer circumference face of the knife cylinder, the ring moving units moving the respective fixing rings to positions at which the both end portions of the blade mount are to be fixed, the end portions being along the axis direction of the knife cylinder, and the fixing devices fixing the respective corresponding fixing rings to the outer circumference face of the knife cylinder at the positions. The configuration of the device realizes the method of the present invention and attains the same effects as those of the method of the present invention. Furthermore, the blade mount can be attached automatically.

Still further, the present invention provides a blade mount that is to be held and fixed on the outer circumference of a knife cylinder in a rotary die cutter, the blade mount being positioned on the outer circumference face of the knife cylinder, the blade mount including: descending slopes formed the entire outer edges on the both end portions along the axis direction of the knife cylinder; and a fitting section that has a recess and a projection along the circumference face of the knife cylinder and that is formed on at least part of each end faces along the circumference direction of the knife cylinder; the both end portions along the axis direction of the knife cylinder being held by the fixing rings and the fitting sections being fitted to stoppers of a fixing members attached to the outer circumference face of the knife cylinder, so that the blade mount is fixed to the outer circumference face of the knife cylinder. This configuration can eliminates the requirement of bolts to fix the blade mount to the outer circumference face of the knife cylinder. For this reason, the time to attach and detach the blade mount is a much shorter time, and the operation efficiency of the rotary die cutter can be greatly enhanced.

EMBODIMENT TO CARRY OUT INVENTION

Hereinafter, the present invention will now be described using embodiments illustrated in the accompanying drawings. There is no intention to restrict the detailed arrangement of each part unless particularly specified. There is no intention to restrict the size, the material, the shape, and the relative arrangement of a part to other parts to those described unless particularly specified.

First Embodiment

Figure 1:
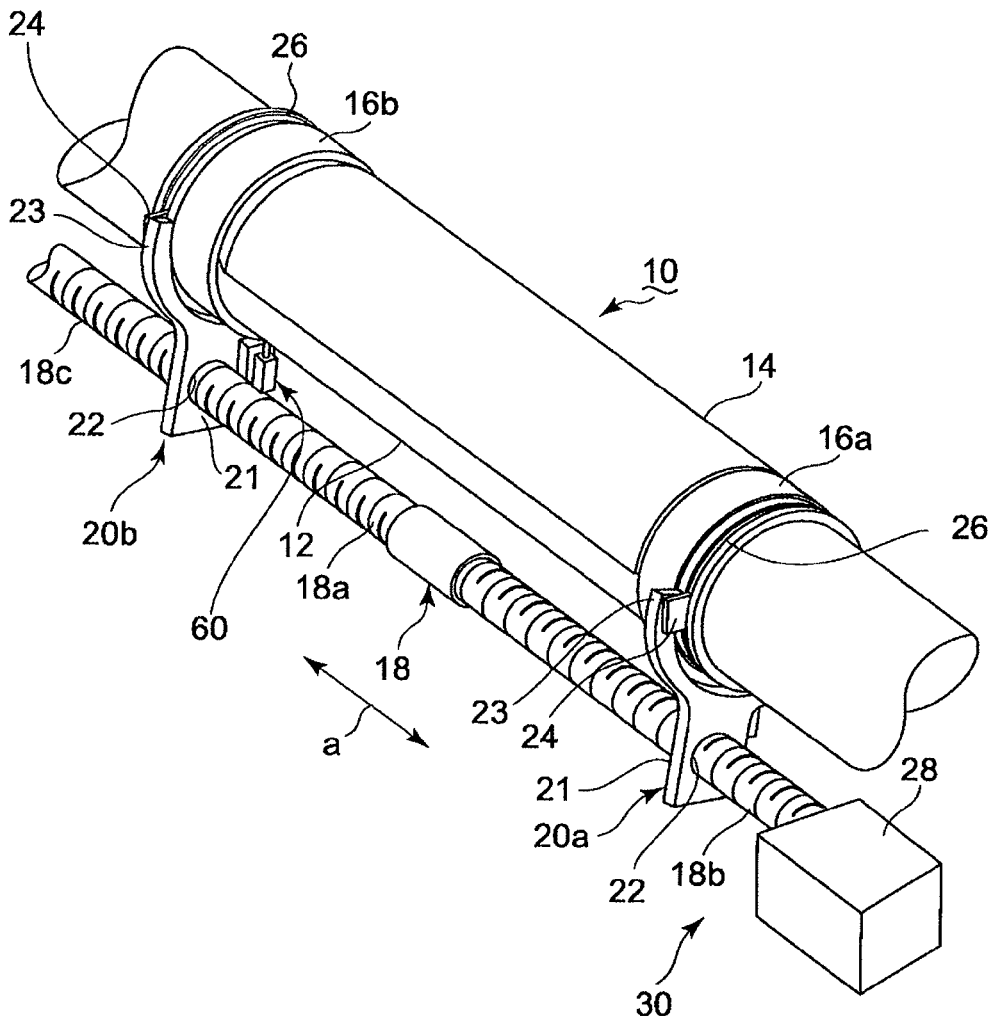
FIG. 1 A perspective view of a knife cylinder according to a first embodiment of the method and the apparatus of the present invention.
Figure 2A:
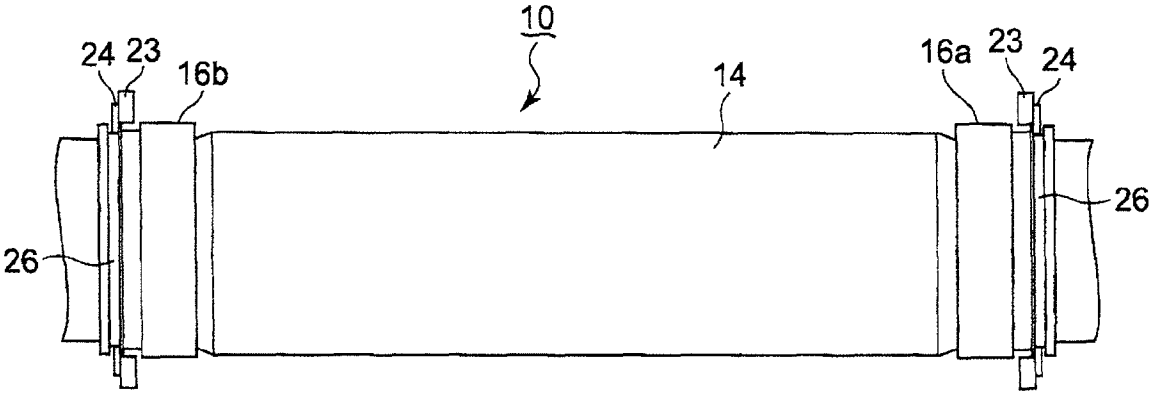
FIG. 2 (A) being a plan view of a knife cylinder of FIG. 1 and (B) being a front view of a knife cylinder of FIG. 1.
Figure 14A:
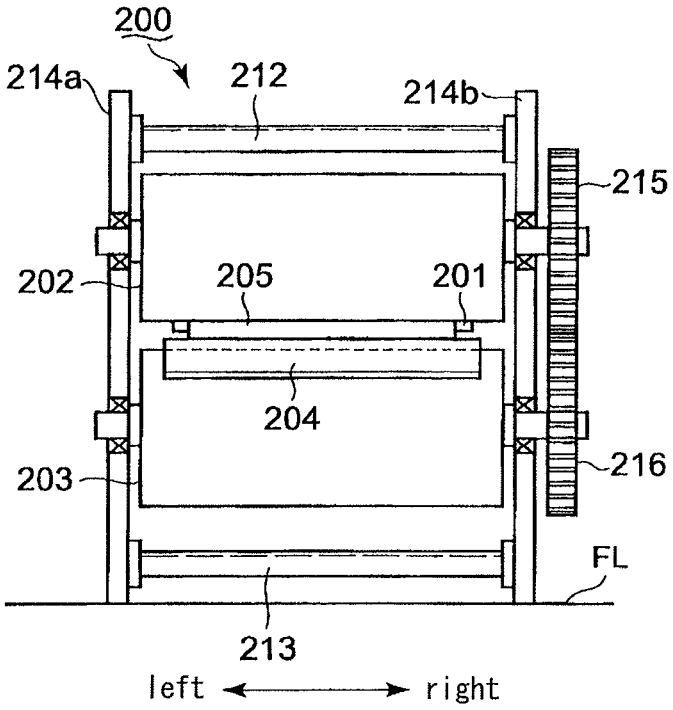
FIG. 14 A diagram illustrating the entire configuration of a rotary die cutter: (A) being a front view and (B) being a right-side view.
Figure 14B:
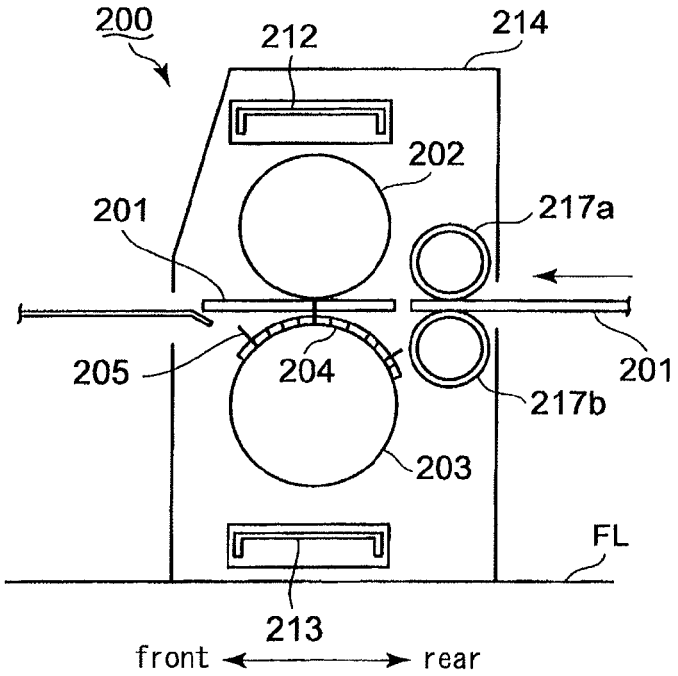
Figure 15A:
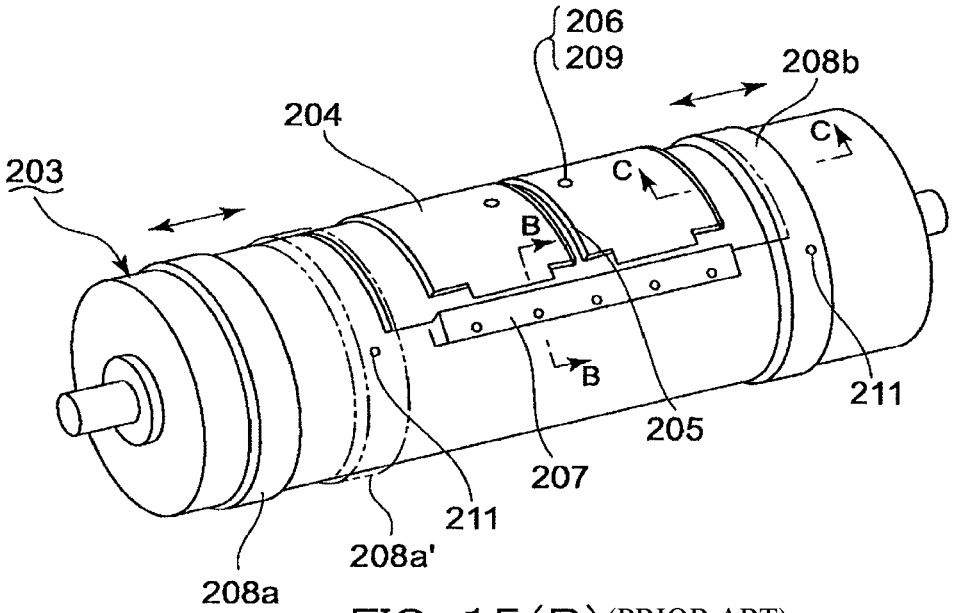
FIG. 15(A) (PRIOR ART)
FIG. 15 A perspective view of a conventional apparatus of fixing a blade mount.
Figure 15B:
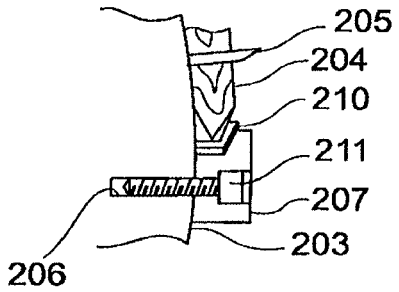
FIG. 15(B) (PRIOR ART)
Figure 15C:
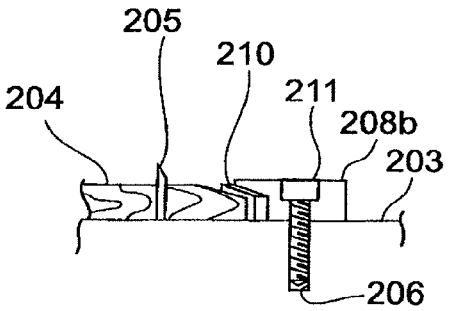
FIG. 15(C) (PRIOR ART)

A first embodiment of the present invention will now be described with reference to FIGS. 1-5. FIGS. 1 and 2 are entire drawings of a knife cylinder 10 of the first embodiment. In FIGS. 1 and 2, a blade mount 14 is attached to the outer circumference face 12 of the knife cylinder 10, and the both end portions of the blade mount 14 along the axis direction of the knife cylinder 10 are fixed by two fixing rings 16*a* (driving side) and 16*b* (operating side). The outer circumference face 12 of the knife cylinder 10 takes a shape of a cylinder, and the upper half of the outer circumference face 12 is covered by a blade mount 14 having the same radius of curvature. The blade mount 14 is normally made of wood, and a cutting knife, which is however omitted in FIGS. 1 and 2, is mounted on the blade mount 14, as shown in FIGS. 14 and 15.

Near the knife cylinder 10, a screw axis 18 is disposed parallel to the axis of the knife cylinder 10. Two moving mounts 20*a* and 20*b* are attached to the screw axis 18. A screw hole 22 is disposed on a base 21 of each of the moving mounts 20*a* and 20*b*, and a screw axis 18 is screwed with the screw hole 22. Before the blade mount 14 is fixed to the outer circumference face 12 of the knife cylinder, the moving mounts 20*a* and 20*b* are arranged together with the fixing rings 16*a* and 16*b* on the both end portions of the knife cylinder 10 so that the moving mounts 20*a* and 20*b* and the fixing rings 16*a* and 16*b* are evacuated from the center portion of the knife cylinder 10.

A rectangular yoke plate 24 is fixed to the top 23 of each of the moving mounts 20*a* and 20*b*. The fixing rings 16*a* and 16*b* each have cylindrical inner surface. The fixing rings 16*a* and 16*b* are freely fitted to the knife cylinder 10 so as to be movable on the outer circumference face 12 of the knife cylinder along the axis direction of the knife cylinder. A recess groove 26 is formed on the outer circumference face of each of the fixing rings 16*a* and 16*b* so as to extend the circumference direction of the ring. The yoke plate 24 is placed inside the recess groove 26. With this configuration, movement of the moving mounts 20*a* and 20*b* on the screw axis 18 causes the fixing rings 16*a* and 16*b* to move along the axis direction of the knife cylinder together with the moving mounts 20*a* and 20*b*.

As illustrated in FIG. 1, a driving unit 28 that rotates the screw axis 18 is disposed at one end (driving side) of the screw axis 18. The screw axis 18, the moving mounts 20*a* and 20*b*, and the driving unit 28 collectively function as a moving unit 30 that moves the fixing rings 16*a* and 16*b* along the axis direction of the knife cylinder. The screw axis 18 is composed of a flat portion 18*a* that positions at the center portion along the axis direction of the knife cylinder, and the threaded portions 18*b* and 18*c* that position on the both sides of the flat portion 18*a* and that are threaded in respective different directions.

Hereinafter, description will now be made in relation to the manner of attaching the blade mount 14 to the outer circumference face 12 of the knife cylinder 10. First of all, the fixing rings 16*a* and 16*b* are evacuated to the both end portions of the knife cylinder 10. Under this arrangement, the operator places the blade mount 14 onto the outer circumference face 12 of the knife cylinder and determines the position of the blade mount 14. The position of the blade mount 14 is determined by the operator holding the blade mount 14 by hand or by partially fixing the blade mount 14 onto the outer circumference face 12 with an installing bolt.

Figure 3:
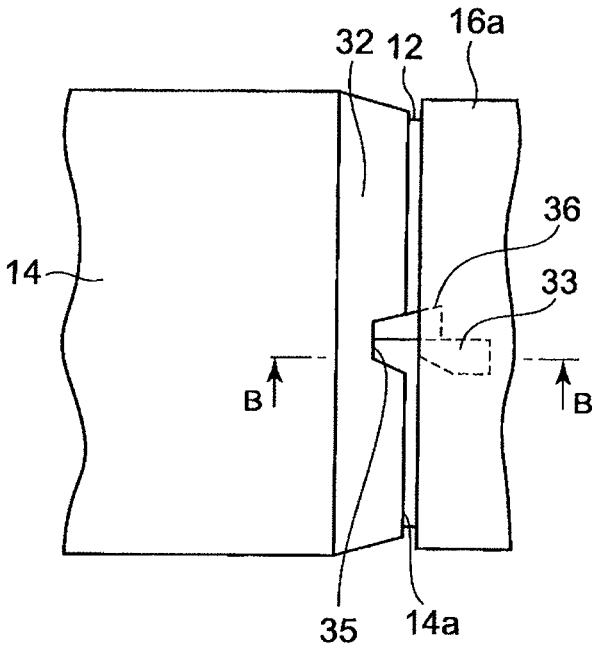
FIG. 3 A partial enlarged plan view of a knife cylinder of FIG. 1.
Figure 4:
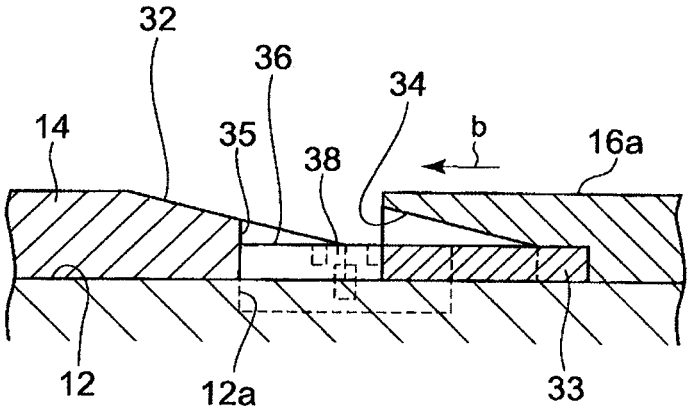
FIG. 4 A sectional view along the line B-B of FIG. 3.

As illustrated in FIGS. 3 and 4, the stopper 36 having a trapezoidal shape face is fixed to a recess 12*a* formed on the outer circumference face 12 of the knife cylinder by a bolt 38 beforehand. The upper portion of the stopper 36 projects from the outer circumference face 12 of the knife cylinder. The position of the blade mount 14 is determined such that the stopper 36 is fitted into a recess 35 formed on the blade mount 14. The stopper 36 is mounted on the outer circumference face 12 of the knife cylinder so as to face each end face 14*a* along the axis direction of the knife cylinder.

Placing the blade mount 14 at the determined position, the driving unit 28 rotates the screw axis 18. Since the screw axis 18 has the threaded position 18*b* and 18*c* threaded in opposite directions, rotation of the screw axis 18 causes the moving mounts 20*a* and 20*b* to move in respective different directions (i.e., the directions of arrow a) symmetrically centered at the flat portion 18*a*.

Rotation of the screw axis 18 moves the moving mounts 20*a* and 20*b* on the knife cylinder in the opposite directions and thereby, the fixing rings 16*a* and 16*b* located at the both end portions of the knife cylinder 10 move toward the center of the knife cylinder 10. Consequently, the fixing rings 16*a* and 16*b* move to respective positions in the vicinity of the position of attaching the blade mount 14.

Next, description will now be made in relation to a manner of fixing the blade mount 14 by the fixing rings 16*a* and 16*b* with reference to FIGS. 3 and 4, focusing on the fixing ring 16*a* disposed on the driving side.

The entire circumference of both end portions of the blade mount 14 along the axis direction of the knife cylinder is each chamfered into a descending slope 32. Conversely, the entire circumference of the end of the fixing ring 16*a* facing the blade mount 14 is also chamfered into a rising slope 34.

On the outer circumference face 12 of the knife cylinder, the above recess 12*a* is formed, and the lower portion of the stopper 36 is embedded in the recess 12*a*. The stopper 36 is mounted on the outer circumference face 12 of the knife cylinder by the bolt 38. Under this arrangement of the parts, the operator places the blade mount 14 on the outer circumference face 12 of the knife cylinder and determines the position of the blade mount 14 such that the stopper 36 fits into the recess 35. A tapering-off piece 33 is fixed to an end face of the fixing ring 16*a* which face is opposite to the blade mount 14.

Next, the moving mount 20*a* is moved along the axis direction of the knife cylinder and thereby the fixing ring 16*a* moves in the direction of arrow b in FIG. 4. The piece 33 is inserted into the recess 35 keeping contact with the side wall of the stopper 36. Under the state of the piece 33 being fitted into the 35, the rotation of the screw axis 18 is ceased, and the movement of the fixing ring 16*a* is stopped. The fixing ring 16*b* is operated in the same manner as the above on the other end portion of the blade mount 14 of the knife cylinder.

The above manner makes it possible to concurrently determine the positions of the blade mount 14 with respect to the axis and the circumference directions by positioning the blade mount 14 such that the piece 33 is fitted into the recess 35 on the each end portion of the blade mount 14.

Next, fixing units 40 fix the fixing rings 16*a* and 16*b* at the positions determined in the above manner. FIG. 5 focuses on the fixing ring 16*a* and depicts the configuration of the fixing unit 40 that fixes the fixing ring 16*a* to the outer circumference face 12 of the knife cylinder. The other fixing unit 40 having the same configuration is provided for the fixing ring 16*b*.

Figure 5B:
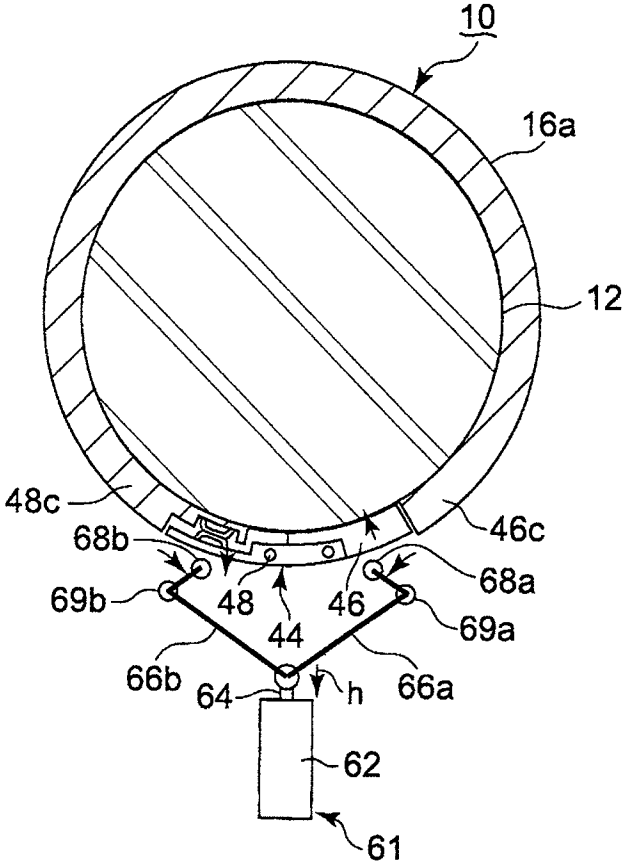
FIG. 5 A sectional view along the line A-A of FIG. 2(B): (A) illustrating a state of a brake pad moving backward and (B) illustrating a state of the brake pad moving forward.
Figure 5A:
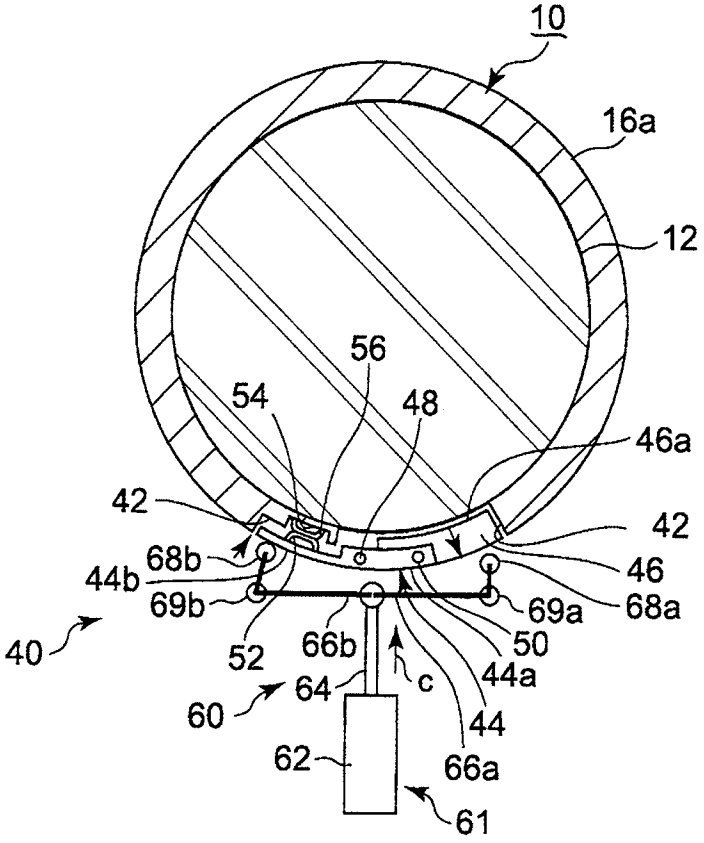

FIG. 5(A) represents a state of the fixing ring 16*a* not being fixed to the outer circumference face 12 while the FIG. 5(B) represents a state of the fixing ring 16*a* being fixed to the outer circumference face 12.

The fixing ring 16*a* of FIG. 5 includes a notch 42, which is formed on part (lower part) of the circumference direction of the fixing ring 16*a* and which is equipped with a lever 44 and a depressing board 46. The lever 44 is rotatably mounted on the axis 48 attached to the fixing ring 16*a*. To one end 44*a* of the lever 44, the depressing board 46 is attached via a pin 50 so as to be rotatable around the lever 44. A depressing face 46*a* of the depressing board 46 which face is opposite to the outer circumference face 12 of the knife cylinder takes an arc shape having the same curvature with that of the outer circumference face 12 so that the depressing face 46*a* can be brought into an intimate contact with the outer circumference face 12.

On a back surface of the other end 44*b* of the lever 44, a disc spring 52 is mounted. A disc spring 56 is attached to recess 54 of the fixing ring 16*a* so as to be opposite to the disc spring 52. At the end 44*b* of the lever 44, the disc springs 52 and 56 exercise resilience on each other and the resilience depresses the depressing face 46*a* of the depressing board 46 against the outer circumference face 12. Thereby, when activating unit 60 to be detailed below is not working, the depressing face 46*a* of the depressing board 46 is in intimate contact with the outer circumference face 12 as depicted in FIG. 5(B) and thereby the fixing ring 16*a* is fixed to the outer circumference face 12.

Figure 2B:
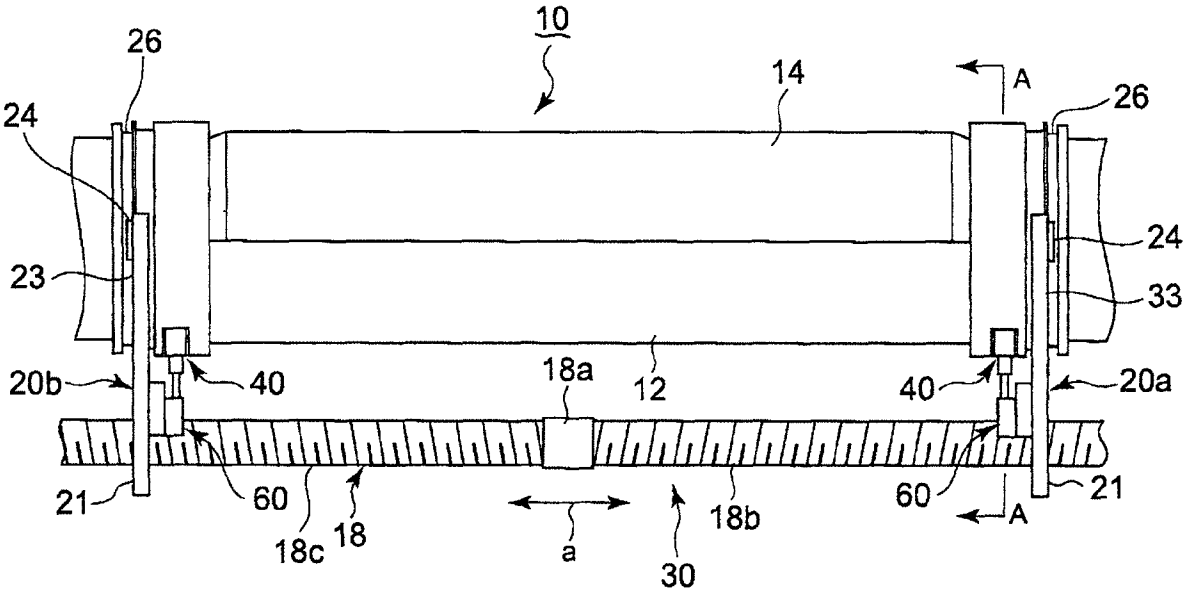

Next, description will now be made in relation to the activating unit 60 releasing the fixing state of the fixing ring 16*a*. As depicted in FIG. 2(B), the activating units 60 are attached to side faces of the moving mounts 20*a* and 20*b*. As depicted in FIG. 5, each activating unit 60 consists of an air cylinder 61 including a cylinder section 62 attached to the side face of the moving mount 20*a* or 20*b* and a piston rod 64, and a pair of arms 66*a* and 66*b* attached to the tip of the piston 64. The arms 66*a* and 66*b* are L shapes and depressing rolls 68*a* and 68*b* are rotatably mounted on the tips of the arms 66*a* and 66*b*, respectively.

As depicted in FIG. 5(A), when the piston rod 64 projects in the direction of arrow c, the arms 66*a* and 66*b* rotate around fulcra 69*a* and 69*b*, respectively, so that the depressing roll 68*a* depresses the end 44*b* of the lever 44. Thereby, the end 44*b* rotates toward the outer circumference face 12 resisting the resilience of the disc springs 52 and 56. Consequently, the depressing face 46*a* of the depressing board 46 separated from the outer circumference face 12 of the knife cylinder, which releases the fixing state of the fixing ring 16*a* to the outer circumference face 12, as depicted in FIG. 5(A).

After that, the moving mounts 20*a* and 20*b* are slightly moved to separate the yoke plates 24 from the inner face of the recess grooves 26 of the fixing rings 16*a* and 16*b*. With this arrangement of the parts, the rotary die cutter is operated.

Then, after the operation of the rotary die cutter is stopped, the fixing state of the fixing rings 16*a* and 16*b* is released by projecting the piston 64 of the air cylinder 61 in the direction of arrow c as depicted in FIG. 5(A) so that the fixing rings 16*a* and 16*b* are brought into the state depicted in FIG. 5(A).

A pair of two fixing units 40 having the levers 44 that direct different directions cooperatively function and provide for each of the fixing rings 16*a* and 16*b*. The two fixing units 40, serving as a pair, are attached to the fixing ring 16*a* or 16*b* in the axis direction of the knife cylinder so as to have a minute interval. A pair of two fixing units 40 has the levers 44 disposed in opposite directions. The air cylinders 61 concurrently apply loads to the two levers 44 and thereby the balance of load on the fixing ring 16*a* or 16*b* can be acquired.

In the first embodiment, there is possibility of upwardly warping the center portion of the blade mount 14, which is preferably avoided by a depressing mechanism exemplified by a bolt that depresses the center portion of the blade mount 14 so as to keep contact with the outer circumference face 12 of the knife cylinder.

According to the first embodiment, the blade mount 14 can be fixed to the outer circumference face 12 of the knife cylinder without a bolt and fixing and releasing the blade mount 14 with the fixing rings 16*a* and 16*b* can automatically be accomplished. Consequently, time for attaching and detaching the blade mount 14 can greatly be reduced, so that the operation efficiency of a rotary die cutter can be improved.

During the operation of the rotary die cutter, the yoke plates 24 can be separated from the recess grooves 26 of the fixing rings 16*a* and 16*b* to avoid abrasion of the yoke plate 24. Concurrently, since the fixing units 40 fix the fixing rings 16*a* and 16*b*, the retention force on the blade mount 14 does not lower during the operation of the rotary die cutter.

The descending slope 32 and the rising slope 34 of the blade mount 14 have the same tilt angle and are in contact with each other over the entire surfaces, so that friction force between the two surfaces can be large. Therefore the fixing rings 16*a* and 16*b* can firmly fix the blade mount 14.

The presence of the moving unit 30, the fixing units 40, and the activating units 60 makes it possible to automatically fix the blade mount 14. The single operator can concentrate on holding the blade mount 14 and therefore can solely fix the blade mount 14.

In addition, the fixing rings 16*a* and 16*b* can be fixed and released by simple and inexpensive configuration consisting of the levers 44, the depressing boards 46, and the disc springs 52 and 56.

Second Embodiment

Next, description will now be made in relation to another example of the configuration of the fixing unit 40 and the activating unit 60 with reference to FIG. 6. FIG. 6 corresponds to FIG. 5, which represents the section A-A of FIG. 2. In this embodiment, the fixing rings 16*a* and 16*b* disposed at the driving side and the operating side, respectively, include fixing units 70 and activating units 90 having the same configurations at the both ends.

FIG. 6 focuses on the fixing ring 16*a* disposed at the driving side and describes the configuration of the fixing ring 16*a*. In FIG. 6, the fixing ring 16*a* of this embodiment includes a notch 74 having a notch face 72 that forms an acute angle with respect to the outer circumference face 12 of the knife cylinder 10 at part (lower part) of the circumference direction of the fixing ring 16*a*. The fixing unit 70 includes a pair of brake pads 76 and 78 disposed at the notch 74 so as to be rotatable in the circumference direction of the fixing ring 16*a*. In the notch 74, a spring bracket 80 is formed integrally with the fixing ring 16*a*.

The brake pads 76 and 78 include spring bracket 76*a* and 78*a*, respectively, at the positions facing the spring bracket 80. The spring bracket 76*a* and 78*a* project in the radius direction of the knife cylinder. Coil springs 82 and 84 are disposed between the spring brackets 80 and 76*a* and between the spring brackets 80 and 78*a*, respectively.

At the rear ends of the brake pads 76 and 78, the protrusions 76*b* and 78*b* are respectively disposed so as to project in the radius direction of the knife cylinder. The distance between the spring bracket 76*a* and the protrusion 76*b* determines the moving stroke of the brake pad 76; and the distance between the spring bracket 78*a* and the protrusion 78*b* determines the moving stroke of the brake pad 78.

The tips of the brake pads 76 and 78 are formed into wedge inserting edges 76*c* and 78*c*, respectively, so as to be fitted into wedge-shaped space formed between the outer circumference face 12 of the knife cylinder and the notch face 72 of the fixing ring 16*a*.

The activating unit 90, which activates the fixing unit 70, is attached to the side face of the moving mount 20*a* or 20*b*. The activating unit 90 consists of an air cylinder 91 including a cylinder section 92 attached to the side face of the moving mount 20*a* or 20*b* and a piston rod 94, and a pair of arms 96*a* and 96*b* attached to the tip of the piston 94.

Until the fixing rings 16*a* and 16*b* reach points to fix the both end portions of the blade mount 14 along the axis direction of the knife cylinder, the piston rods 94 project in the direction of arrow c and the arms 96*a* and 96*b* rotate around the respective fulcra 98 in the directions of arrow d and arrow e, respectively.

The arm 96*a* moves in the direction of the arrow d and then latches at the protrusion 78*b* of the brake pad 78. Thereby, the arm 96*a* resists the resilience of the coil spring 84 and moves the brake pad 78 in the direction of the arrow g. Meanwhile, the arm 96*b* moves in the direction of the arrow e and then latches at the protrusion 76*b* of the brake pad 76. Thereby the arm 96*b* resists the resilience of the coil spring 82 and moves the brake pad 76 in the direction of the arrow f. Consequently, the inserting edge 76*c* of the brake pad 76 and the inserting edge 78*c* of brake pad 78 come to be separated from the notch face 72.

Figure 6B:
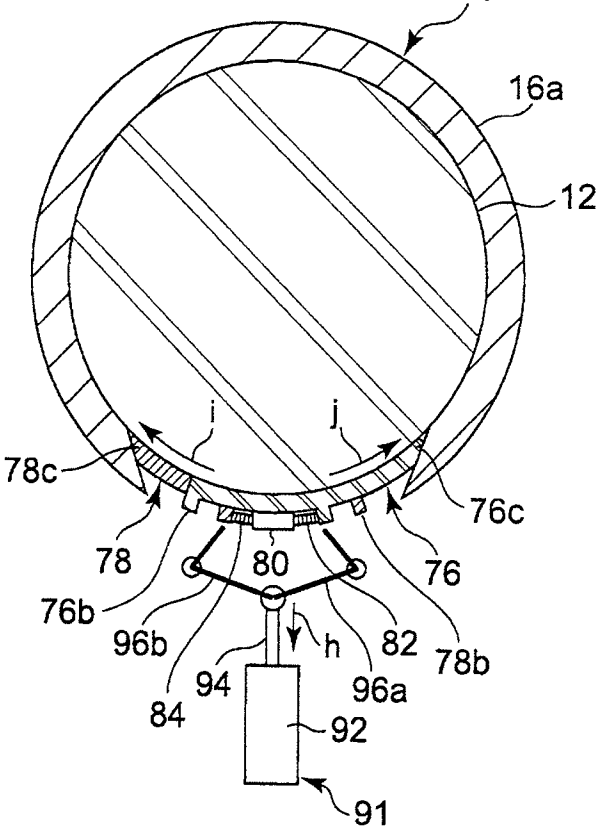
FIG. 6 A cross sectional view (corresponding to FIG. 5) of a knife cylinder according to a second embodiment of the method and the apparatus of the present invention.

When the fixing rings 16*a* and 16*b* reach the positions to hold and fix the both end portions of the blade mount 14 in the axis direction of the knife cylinder, the piston 94 is moved backward in the direction of the arrow h as illustrated in FIG. 6(B), so that the tips of the pair of arms 96*a* and 96*b* come close to each other and the arm 96*a* separates from the protrusion 78*b*, and the arm 96*b* also separates from the protrusion 76*b*. Consequently, the resilience of the coil spring 82 or 84 moves the inserting edge 76*c* in the direction of the arrow j and concurrently moves the inserting edge 78*c* in the direction of the arrow i, so that the inserting edges 76*c* and 78*c* are press-fitted into the wedge spaces between outer circumference face 12 and the notch face 42 of the fixing ring 16*a*.

This configuration increases the friction between the outer circumference face 12 and the fixing rings 16*a* and 16*b*, so that the fixing rings 16*a* and 16*b* can be fixed to the outer circumference face 12 of the knife cylinder.

Similarly to the first embodiment, there is possibility of upwardly warping the center portion of the blade mount 14, which is preferably avoided by a depressing mechanism exemplified by a bolt that depresses the center portion of the blade mount 14 so as to keep contact with the outer circumference face 12 of the knife cylinder.

After that, the moving mounts 20*a* and 20*b* are slightly moved to separate the yoke plates 24 from the inner face of the recess grooves 26 of the fixing rings 16*a* and 16*b*. With this arrangement of the parts, the rotary die cutter is operated.

Figure 6A:
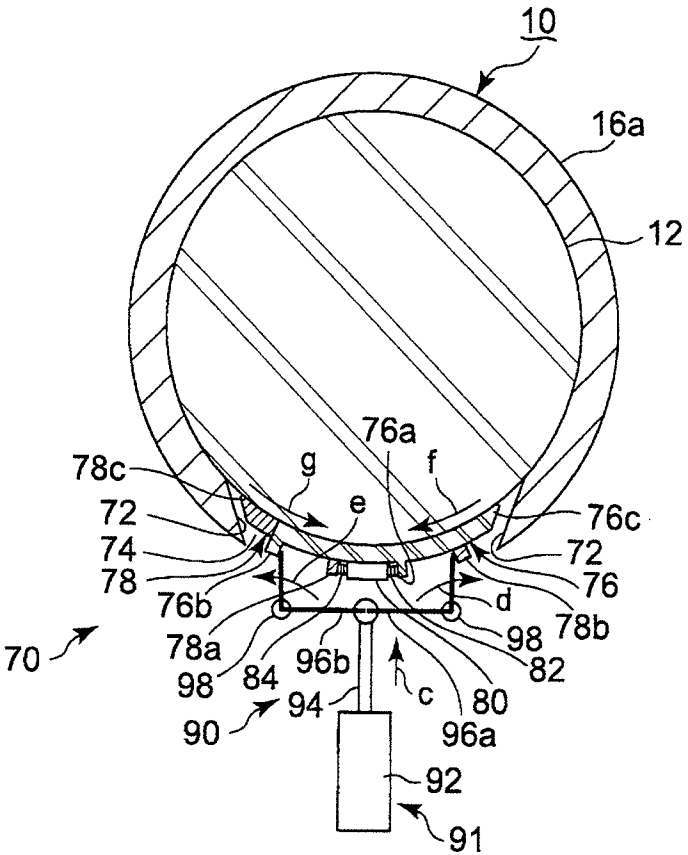

Then, after the operation of the rotary die cutter is stopped, the fixing state of the fixing rings 16*a* and 16*b* is released by projecting the piston 64 of the air cylinder 91 in the direction of arrow c as depicted in FIG. 6(A) so that the fixing rings 16*a* and 16*b* are brought into the state depicted in FIG. 6(A).

Likewise the first embodiment, the blade mount 14 can be fixed to the outer circumference face 12 of the knife cylinder without a bolt and fixing and releasing the blade mount 14 with the fixing rings 16*a* and 16*b* can automatically be accomplished also in this embodiment. Consequently, time for attaching and detaching the blade mount 14 can greatly be reduced, so that the operation efficiency of a rotary die cutter can be improved.

During the operation of the rotary die cutter, the yoke plates 24 can be separated from the recess grooves 26 of the fixing rings 16*a* and 16*b* to avoid abrasion of the yoke plate 24. Concurrently, since the fixing units 70 fixes the fixing rings 16*a* and 16*b*, the retention force on the blade mount 14 does not lower during the operation of the rotary die cutter.

The descending slope 32 and the rising slope 34 of the blade mount 14 have the same tilt angle and are in contact with each other over the entire surface, so that friction force between the two surfaces can be large. Therefore the fixing rings 16*a* and 16*b* can firmly fix the blade mount 14.

The presence of the moving unit 30, the fixing units 70, and the activating units 90 makes it possible to automatically fix the blade mount 14. The single operator can concentrate on supporting the blade mount 14 and therefore can solely fix the blade mount 14.

In addition, since the inserting edge 76*c* and 78*c* of the brake pads 76 and 78 are in wedge forms and the notch face 72 is in a wedge form as well, placing the inserting edges 76*c* and 78*c* inside the notch face 72 when the fixing rings 16*a* and 16*b* are to fix the blade mount 14 increases the friction, so that the retention force of the fixing rings can be increased.

The configurations of the fixing units 70 and the activating units 90 are not restricted to those of this embodiment and may alternatively switch between the fixed position and the non-fixed position of the inserting edges 76*c* and 78*c* of the brake pads 76 and 78 by means of, for example, a cam.

Third Embodiment

Figure 7:
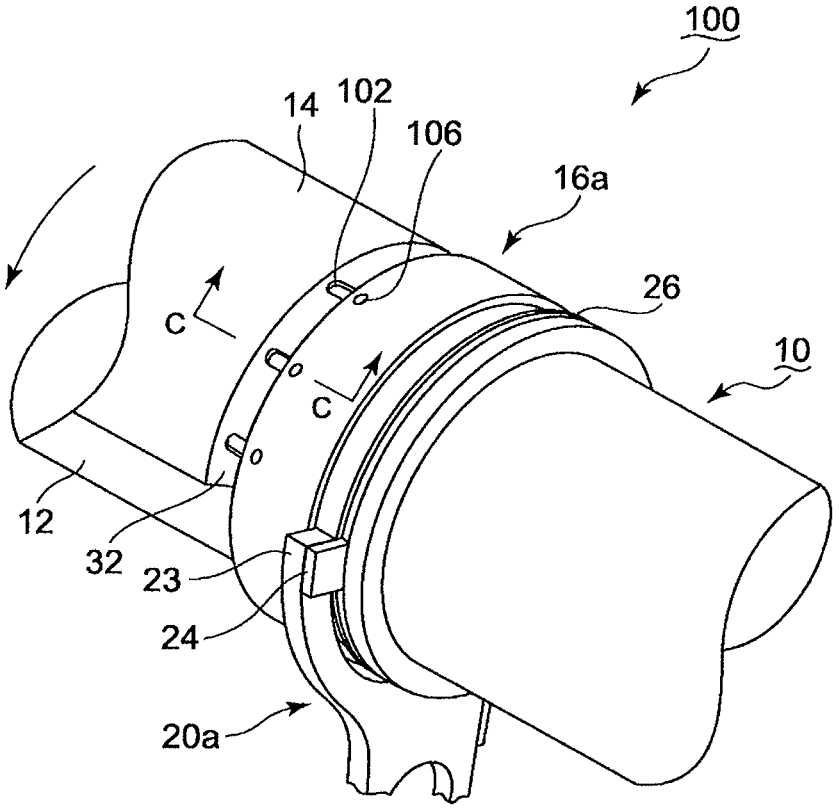
FIG. 7 A perspective view of part of a knife cylinder according to a third embodiment of the method and the apparatus of the present invention.

Next, description will now be made in relation to a modification to a device for determining the positions of the fixing rings 16*a* and 16*b* to the blade mount 14 with reference to FIGS. 7 and 8, which focus on the configuration on the side including the fixing ring 16*a*. In a position determining device 100 of this embodiment depicted in FIGS. 7 and 8, a number of pin grooves 102 arranged on the descending slope 32 of the blade mount 14 in the circumference direction at predetermined intervals. In contrast, the rising slope 34 of the fixing ring 16*a* has a number of pin holes 104 having circular sections and being disposed in the circumference direction at the same intervals as that of the pin grooves 102. In each pin hole 104, a fixing pin 106 is press-fitted.

Figure 8A:
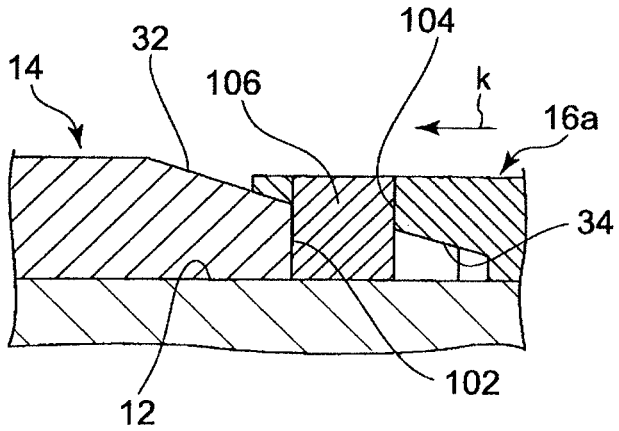
FIG. 8 A sectional view along the line C-C of FIG. 7: (A) being a state of a blade mount being fixed and (B) illustrating a state of a fixing ring moved backward from a fixing position.
Figure 8B:
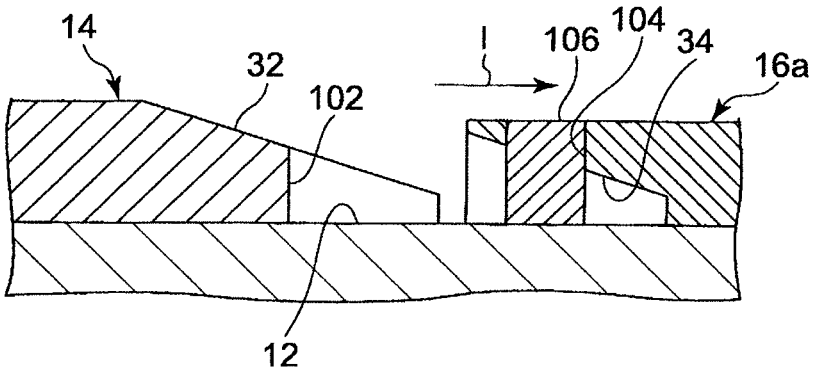

As depicted in FIG. 8, since the descending slope 32 and the rising slope 34 have the same tilt angle, moving the fixing ring 16*a* in the direction of the arrow k by the moving unit 30 brings the entire surface of the descending slope 32 into contact with the entire surface of the rising slope 34. Concurrently, the fixing pin 106 is inserted into each pin groove 102. With this arrangement of the components, the rotation of the screw axis 18 is stopped and the fixing ring

16*a* is stopped. The fixing ring 16*b* is operated in the same manner. Next, the fixing rings 16*a* and 16*b*, at the stopped points, are fixed to the outer circumference face 12 of the knife cylinder using the fixing unit 40 or 70.

Thereby, the both end portions of the blade mount 14 along the axis direction of the knife cylinder are fixed by the fixing rings 16*a* and 16*b*.

This fixing means makes it possible to determine the circumference-direction position of the blade mount 14 using only a simple configuration that the pin grooves 102 are formed on the blade mount 14 and the fixing pins 106 are provided on the fixing rings 16*a* and 16*b*. In addition, since no components are attached to the outer circumference face 12 of the knife cylinder, the outer circumference face 12 does not impede in arranging the blade mount 14.

Fourth Embodiment

Figure 9:
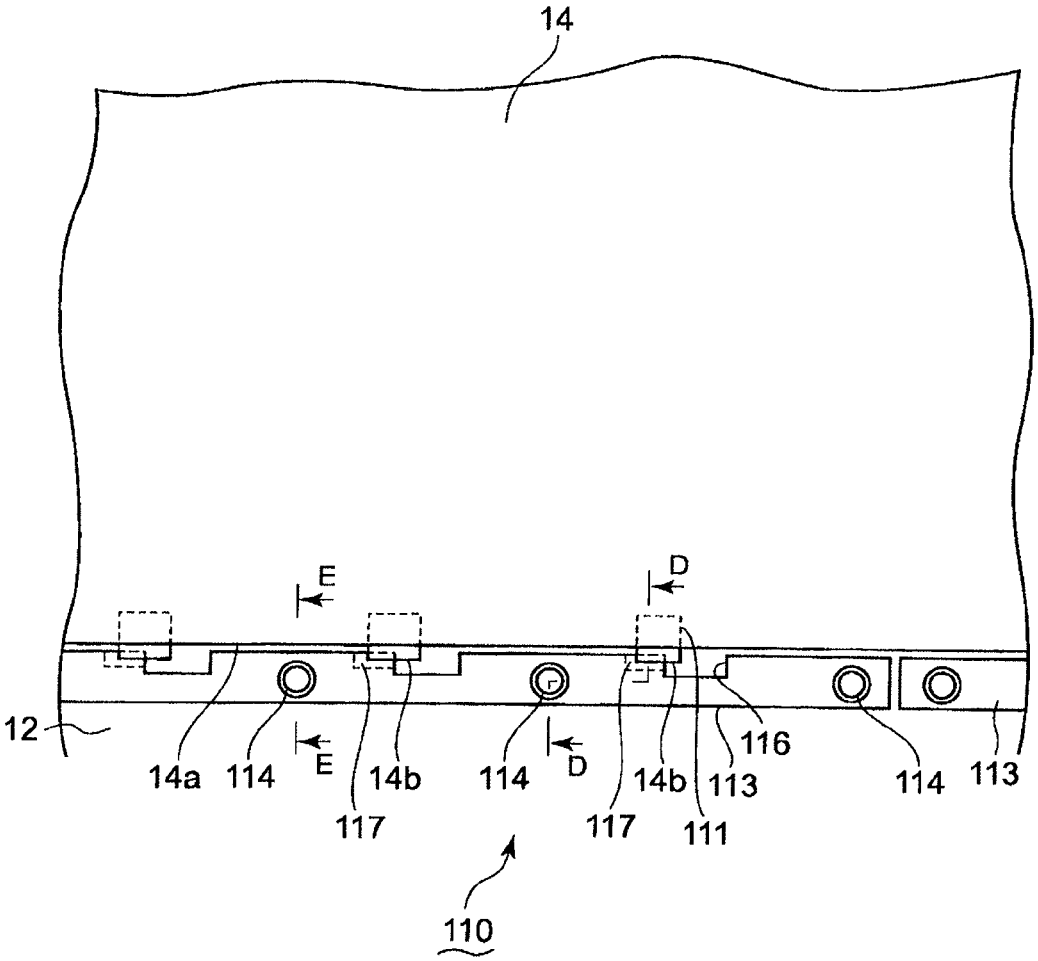
FIG. 9 An enlarged front view of part of a blade mount according to a fourth embodiment of the method and the apparatus of the present invention.
Figure 10:
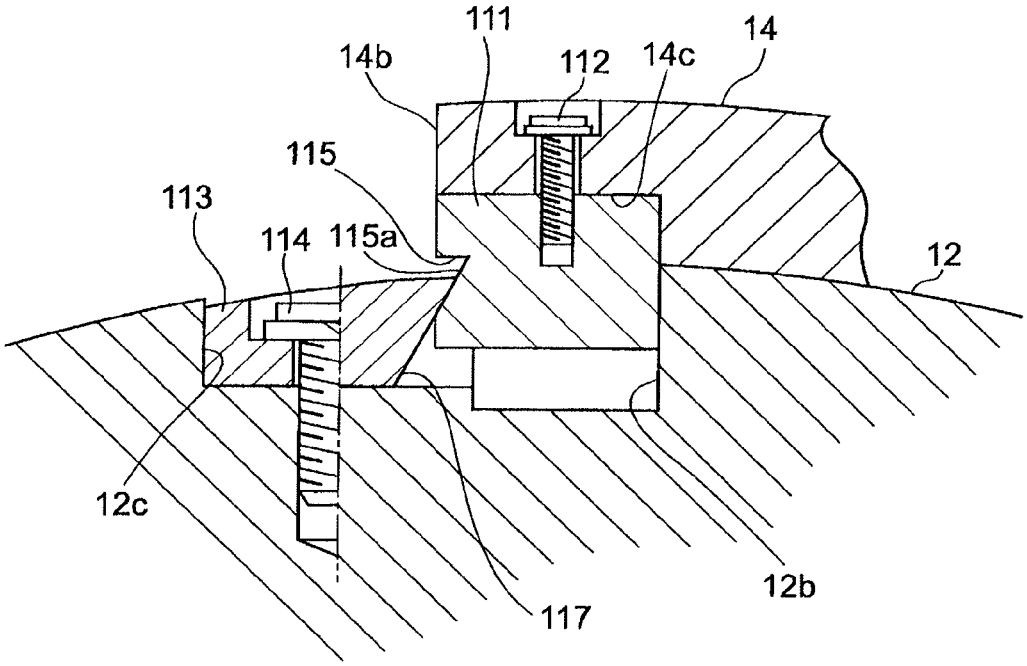
FIG. 10 A sectional view along the line D-D of FIG. 9.
Figure 11:
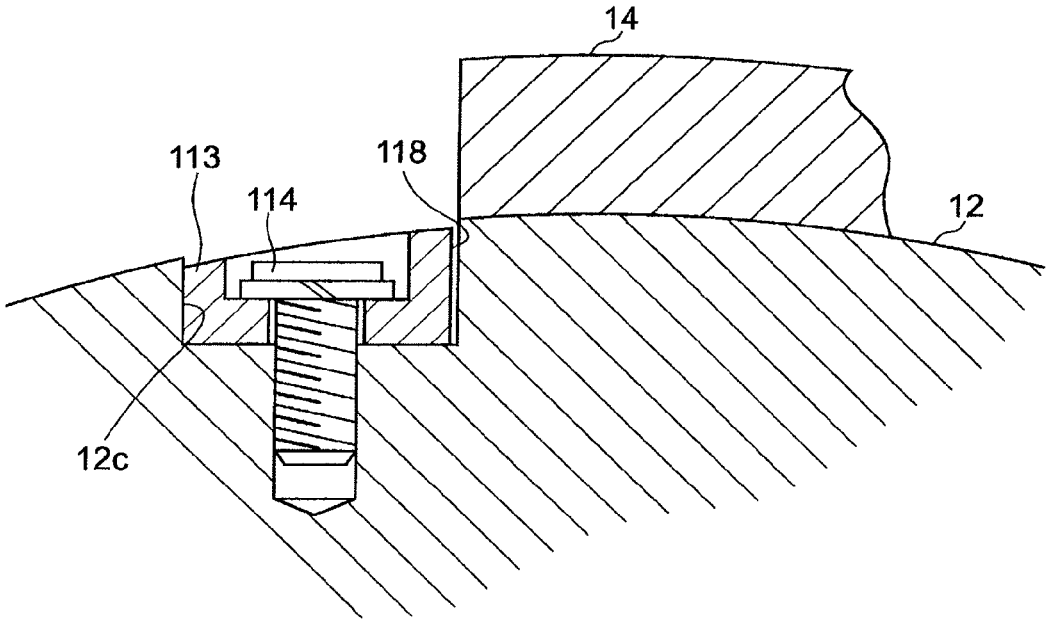
FIG. 11 A sectional view along the line E-E of FIG. 9.

Next, a fourth embodiment of the method and apparatus of the present invention will now be described with reference to FIGS. 9-11. This embodiment relates to fixing means that fixes the both end portions of the blade mount 14 in the circumference direction. As depicted in FIG. 9, in a fixing unit 110 of this embodiment, a number of protrusions 14*b* are formed along the both end faces 14*a* of the blade mount 14 which faces are disposed in the circumference direction of the knife cylinder. A recess 14*c* is curved beneath each protrusion 14*b*. Recesses 12*b* are formed on the outer circumference face 12 facing the recesses 14*c*.

A rectangular-parallelepiped fitting piece 111 is fixed inside each recess 14*c* via a bolt 112. The lower part of each fitting piece 111 is placed in the recess 12*b*. A long recess 12*c* is formed in the axis direction of the knife cylinder so as to face each recess 12*b*. A long fixing piece 113 is inserted into each recess 12*c* and fixed inside the recess 12*c* via a bolt 114. The top face of the fixing piece 113 does not project from the outer circumference face 12 of the knife cylinder. As depicted in FIG. 9, the fixing piece 113 may be divided into a number of components, which are serially arranged in the axis direction of a knife cylinder.

Each fitting piece 111 has a triangle-section recess 115 on the face opposite to the fixing piece 113, and the recess 115 has a descending slope 115*a*. In the meantime, the fixing piece 113 has notches 116 as many as the number of fitting pieces 111 so as to face to the fitting pieces 111, and concurrently includes a rising slope 117 adjacent to each notch 116. As depicted in FIG. 11, the walls of each fixing piece 113 except for the slope 117 are vertical wall 118.

With this configuration, when the blade mount 14 is to be mounted to the outer circumference face 12 of the knife cylinder, each protrusion 14*b* is placed so as to opposite to the corresponding notch 116 and inserted into the notch 116, so that the position of the blade mount 14 on the outer circumference face 12 is provisionally determined. Then, the blade mount 14 is moved in parallel to the axis direction of the knife cylinder such that the slope 115*a* of the recess 115 is brought into contact with the slope 117 of the fixing piece 113. Here, the slopes 115*a* and 117 have the same tilt angle.

This completes fixing of the both end portions of the blade mount 14 which end portions are disposed along the circumference direction of the knife cylinder, and then the both end portions of the blade mount 14 which end portions are disposed along the axis direction of the knife cylinder are fixed using the fixing rings 16*a* and 16*b* in the manner described in the first embodiment.

According to this embodiment, the both end portions of the blade mount 14 disposed in the circumference direction of the knife cylinder can be fixed by a single action of the operator in a short time. In addition, the fixing is accomplished by a cheap fixing piece 83, not requiring a large-scale device.

Fifth Embodiment

Figure 12:
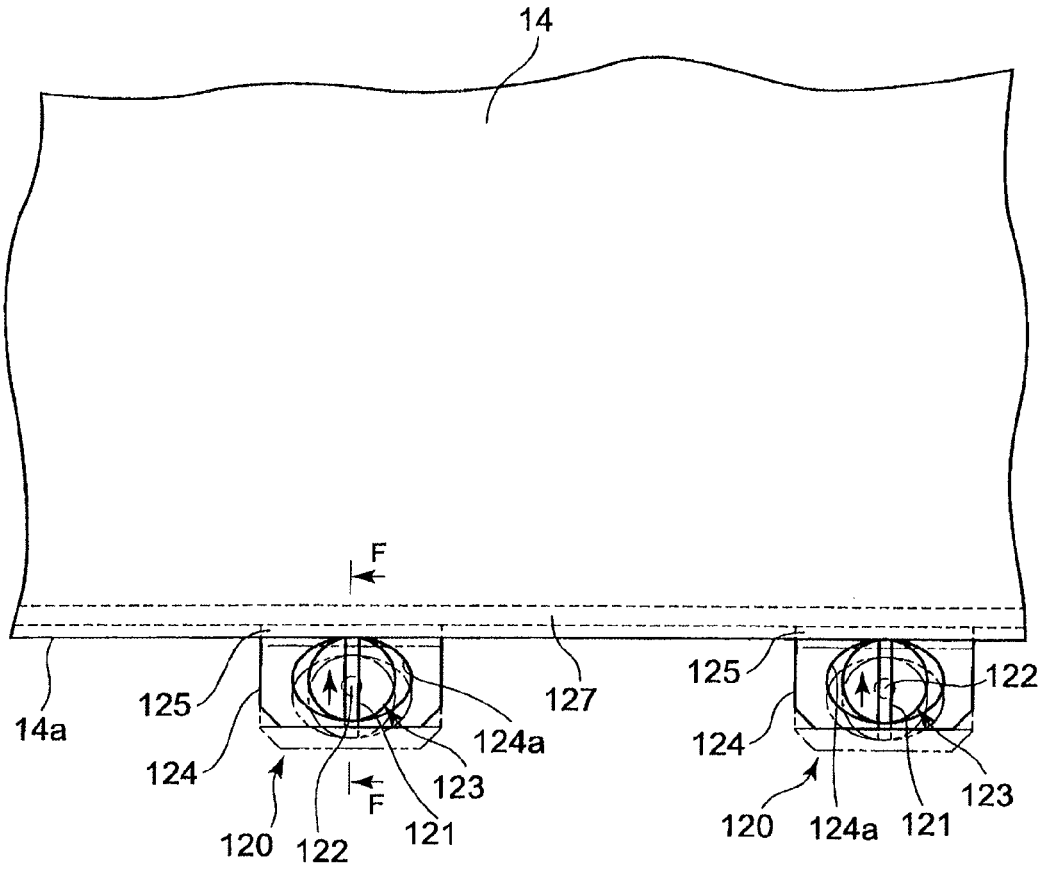
FIG. 12 An enlarged front view of part of a blade mount according to a fifth embodiment of the method and the apparatus of the present invention.
Figure 13:
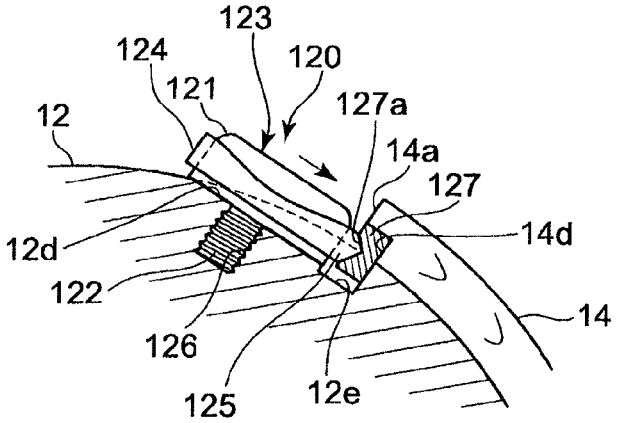
FIG. 13 A sectional view along the line F-F of FIG. 12.

Next, a fifth embodiment of the present invention and device will now be described with reference to FIGS. 12 and 13. As depicted in FIGS. 12 and 13, a number of fixing devices 120 are mounted on the outer circumference face 12 of the knife cylinder 10 along the both end faces 14*a* of the blade mount 14 positioned on the outer circumference face 12 which end faces are disposed along the circumference direction of the knife cylinder. As depicted in FIG. 13, each fixing device 120 has a short-cylindrical rotating member 123 having a handle 121 integrally disposed on the top and a bolt 92 disposed at the lower part and eccentric to the center, and a square frame 124 accommodating the rotating member 123. An elliptic hole 124*a* is formed at the center of the frame 124, and rotatably accommodates the rotating member 123.

A V-section protrusion 125 projects from a side face of the frame 124 which face is opposite to each end surface 14*a*. A flat face 12*d* is formed on the outer circumference face 12 of the knife cylinder, and a screw hole 126 is formed on the flat face 12*d*. A bolt 122 of each fixing device 120 is screwed with the screw hole 126. Recesses 14*d* are formed on the both end portions of the blade mount 14 which end portions are disposed in the circumference direction of the knife cylinder along the both ends. A long fitting piece 127 is bound to each recess 14*d*. Each fitting piece 127 has a V-section recess 127*a*, to which the protrusion 125 is fitted.

With this configuration, the fixing devices 120 are previously mounted on the outer circumference face 12 of the knife cylinder. At that time, the protrusion 125 is directed to position where the blade mount 14 is arranged, and concurrently the fixing devices 120 are withdrawn from the blade mount. With this arrangement of components, the position of the blade mount 14 on the outer circumference face of the knife cylinder is determined. Part of the fitting piece 127 that projects from the bottom of the blade mount 14 is accommodated in a recess 12*e* which is formed on the outer circumference face 12 along the axis direction of the knife cylinder.

After that, the operator holds the handle 121 and moves the rotating member 123 keeping contact with the ellipse hole 124*a* and rotates around the bolt 122. Since the bolt 122 is eccentric to the rotating member 123, the rotating member 123 and the frame 124 move in parallel to each other in the direction of the arrow. The protrusion 125 is fitted into the recess 127*a* in this manner, so that the both end faces 14*a* of the blade mount 14 are fixed by the fixing devices 120.

According to this embodiment, the both end faces 14*a* of the blade mount 14 which faces are disposed in the circumference direction of the knife cylinder can be fixed simply by rotation of the rotating member 123 of each fixing device 120 by the operator, so that the blade mount 14 can be mounted to the knife cylinder 10 in a short time. This embodiment is accomplished by a simple configuration that a number of fixing device 120 are arranged on the end surface 14*a* of the blade mount 14, reducing the cost for the fixing device.

INDUSTRIAL APPLICABILITY

The present invention can eliminate the requirement of installing bolts when a blade mount is fixed to a knife cylinder of the rotary die cutter used in processing corrugated board boxes, can attach and detach the blade mount in a shorter time to improve the operation efficiency of the rotary die cutter, and additionally can eliminate abrasion of yokes that move the fixing rings.

The invention claimed is:

1. A method for fixing a blade mount of a rotary die cutter, a cylindrical knife cylinder freely fitting two fixing rings to the knife cylinder, and holding and fixing, using the two fixing rings, the blade mount on an outer circumference face of the knife cylinder at both end portions along an axis direction of the knife cylinder of the blade mount, the method comprising:

moving the two fixing rings, having recess grooves on respective outer circumference faces and being freely fitted to both end portions of the knife cylinder, toward a center of the knife cylinder by moving yokes placed inside the respective recess grooves of the fixing rings;

holding and fixing the blade mount at the both end portions along the axis direction of the knife cylinder by the fixing rings;

fixing the fixing rings to the outer circumference face of the knife cylinder by fixing devices provided one for each of the fixing rings, wherein:

the blade mount has the both end portions along the axis direction of the knife cylinder, the end portions facing the respective fixing rings and having circumference faces entire of which are chamfered into descending slopes;

each of the fixing rings has an end face facing the blade mount and having an inner corner entire of which is chamfered into a rising slope; and the rising slopes of the fixing rings depressing the respective descending slopes fix the both end portions of the blade mount, the end portions being along the axis direction of the knife cylinder, to the outer circumference face of the knife cylinder.

2. A method for fixing a blade mount of a rotary die cutter, a cylindrical knife cylinder freely fitting two fixing rings to the knife cylinder, and holding and fixing, using the two fixing rings, the blade mount on an outer circumference face of the knife cylinder at both end portions along an axis direction of the knife cylinder of the blade mount, the method comprising:

moving the two fixing rings, having recess grooves on respective outer circumference faces and being freely fitted to both end portions of the knife cylinder, toward a center of the knife cylinder by moving yokes placed inside the respective recess grooves of the fixing rings;

holding and fixing the blade mount at the both end portions along the axis direction of the knife cylinder by the fixing rings;

fixing the fixing rings to the outer circumference face of the knife cylinder by fixing devices provided one for each of the fixing rings, wherein:

a fitting section, having a recess and a projection toward a circumference direction of the knife cylinder, is formed on part of each circumferential end face of the blade mount, the face being at each end in the circumference direction of the knife cylinder;

fixing parts, each partially having a stopper that is to be fitted to the fitting section, are embedded into recesses formed on the outer circumference face of the knife cylinder; and the method further comprises determining a position of the blade mount on the outer circumference face of the knife cylinder, and moving the blade mount along the axis direction of the knife cylinder with respect to the fixing parts such that the fitting sections and the stoppers are fitted to each other, so that the blade mount is fixed to the outer circumference face of the knife cylinder.

3. A method for fixing a blade mount of a rotary die cutter, a cylindrical knife cylinder freely fitting two fixing rings to the knife cylinder, and holding and fixing, using the two fixing rings, the blade mount on an outer circumference face of the knife cylinder at both end portions along an axis direction of the knife cylinder of the blade mount, the method comprising:

moving the two fixing rings, having recess grooves on respective outer circumference faces and being freely fitted to both end portions of the knife cylinder, toward a center of the knife cylinder by moving yokes placed inside the respective recess grooves of the fixing rings;

holding and fixing the blade mount at the both end portions along the axis direction of the knife cylinder by the fixing rings;

fixing the fixing rings to the outer circumference face of the knife cylinder by fixing devices provided one for each of the fixing rings, wherein:

a fitting section, having a recess and a projection toward a circumference direction of the knife cylinder, is formed on at least part of each circumferential end face of the blade mount, the faces being at ends in the circumference direction of the knife cylinder;

at least one fixing part having a stopper that is to be fitted to each fitting section is mounted on the outer circumference face of the knife cylinder so as to be rotatable around an eccentric axis; and the method further comprises determining a position of the blade mount on the outer circumference face of the knife cylinder, and rotating the fixing part around the eccentric axis such that the fitting sections and the stoppers are fitted to each other, so that the blade mount is fixed to the outer circumference face of the knife cylinder.

4. A device for fixing a blade mount of a rotary die cutter, a cylindrical knife cylinder freely fitting two fixing rings to the knife cylinder, and fixing, using the two fixing rings, the blade mount on an outer circumference face of the knife cylinder from both end portions along an axis direction of the knife cylinder, the device comprising:

the two fixing rings, each having a recess groove on an outer circumference face and being freely fitted to an end portion of the knife cylinder;

fixing ring moving units each including a yoke that is placed in the recess groove of the corresponding fixing ring, and a driving unit that moves the yoke along the axis direction of the knife cylinder; and fixing devices, provided one for each fixing rings, that fix the respective corresponding fixing rings to the outer circumference face of the knife cylinder, the fixing ring moving units moving the respective fixing rings to positions at which the both end portions of the blade mount are to be fixed, the end portions being along the axis direction of the knife cylinder, and the fixing devices fixing the respective corresponding fixing rings to the outer circumference face of the knife cylinder at the positions, wherein:

each of the fixing devices includes a depressing member being provided on the corresponding one of the fixing rings and having a depressing face that is to be in contact with the outer circumference face of the knife cylinder, and an activating unit that is attached to the corresponding yoke and that moves the depressing member to a position at which the depressing member is depressed against the outer circumference face of the knife cylinder and moves the depressing member to a position at which the depressing of the depressing member is released; and the activating unit cancels the depressing to the depressing member while the corresponding fixing ring is moving, and depresses the depressing member against the outer circumference face of the knife cylinder at the position at which the corresponding fixing ring is to be fixed.

5. The device according to claim 4, wherein each of the activating units includes a spring member that is attached to the corresponding fixing ring and that urges the depressing face of the depressing member to generate elasticity in a direction that the depressing face of the depressing member is depressed against the outer circumference face of the knife cylinder, and a depressing releaser that is attached to the yoke and that releases the depressing of the depressing member against the outer circumference face of the knife cylinder by resisting the elasticity of the spring member, and the depressing releaser is activated while the corresponding fixing ring is moving and is configured not to be activated at the position at which the corresponding fixing ring is to be fixed.

6. The device according to claim 5, wherein:

the depressing member includes a lever attached to the corresponding fixing ring and that is rotatable around an axis of the fixing ring, and a depressing board being attached to a first end of the lever and having the depressing face that is to be in contact with the outer circumference face of the knife cylinder;

the spring member is a disc spring that is attached to a second end of the lever and that urges the depressing face of the depressing board against the outer circumference face of the knife cylinder; and the depressing releaser is an air cylinder that is attached to the yoke and that depresses the second end of the lever so that the depressing of the depressing board against the outer circumference face of the knife cylinder is released.

7. The device according to claim 5, wherein:

a notch face is formed on part of an end face of each of the fixing rings, the end face being in a circumference direction, the notch face forming an acute angle with respect to the outer circumference face of the knife cylinder;

the depressing member has an edge in the form of a wedge that is to be placed into a wedge space formed between the outer circumference face of the knife cylinder and the notch face;

the spring member urges the depressing member to generate elasticity in the direction of inserting the depressing member into the wedge space; and the depressing releaser includes a stopper that moves the depressing member backward from the wedge space, resisting the elasticity of the spring member, and an air cylinder that moves the stopper to a position at which the stopper stops on the depressing member and moves the stopper to a position at which the stopper is separated from the depressing member.

8. The device according to claim 4, the blade mount comprising:

descending slopes formed on an entire outer edges of the both end portions along the axis direction of the knife cylinder facing to the fixing rings; and a fitting section that has a recess and a projection toward a circumference direction of the knife cylinder and that is formed on at least part of each end faces along the circumference direction of the knife cylinder, the both end portions along the axis direction of the knife cylinder being held by the fixing rings and the fitting sections being fitted to stoppers of a fixing members attached to the outer circumference face of the knife cylinder, so that the blade mount is fixed to the outer circumference face of the knife cylinder.

* * * * *